US007325706B2

(12) United States Patent
Sweeton et al.

(10) Patent No.: US 7,325,706 B2
(45) Date of Patent: Feb. 5, 2008

(54) FLEXIBLE FLUID DELIVERY TUBE TO RIGID DIP TUBE QUICK CONNECTOR FOR LIQUID SPRAYER

(75) Inventors: Steve L. Sweeton, Lake Winnebago, MO (US); William L. Driskell, Lee's Summit, MO (US)

(73) Assignee: MeadWestvaco Calmar, Inc., Grandview, MO (US)

( * ) Notice: Subject to any disclaimer, the term of this patent is extended or adjusted under 35 U.S.C. 154(b) by 69 days.

(21) Appl. No.: 11/043,705

(22) Filed: Jan. 26, 2005

(65) Prior Publication Data

US 2005/0189380 A1 Sep. 1, 2005

Related U.S. Application Data

(60) Provisional application No. 60/539,744, filed on Jan. 29, 2004.

(51) Int. Cl.
*B67D 5/40* (2006.01)

(52) U.S. Cl. ..... 222/382; 222/464.1

(58) Field of Classification Search ..... 222/382, 222/383.1, 383.3, 464.3, 464.1, 530, 526–529; 285/23, 24, 921, 242
See application file for complete search history.

(56) References Cited

U.S. PATENT DOCUMENTS 1,798,708 A 3/1931 Smith
1,869,869 A 8/1932 Smith
1,875,992 A 9/1932 Clifford
3,168,248 A 2/1965 Winslow
3,901,449 A 8/1975 Bochmann
4,392,594 A 7/1983 Swett et al.
4,621,770 A 11/1986 Sayen
4,832,237 A 5/1989 Hurford, Jr.
5,154,324 A 10/1992 Stratford
5,469,993 A 11/1995 Hauf et al.
5,553,750 A 9/1996 Foster
D380,148 S 6/1997 Hauf et al.
5,651,908 A 7/1997 Mansfield
5,988,456 A 11/1999 Laible
6,050,459 A 4/2000 Johnson et al.
6,170,706 B1 1/2001 Havlovitz
6,409,052 B1 6/2002 Barriac et al.

*Primary Examiner*—Lien M. Ngo
(74) *Attorney, Agent, or Firm*—Gordon & Jacobson, PC

(57) ABSTRACT

An assembly for effecting a quick connect of a flexible fluid delivery tube to a rigid dip tube for a liquid sprayer is provided. The assembly is mounted to a container of chemical liquid to be sprayed by a closure cap having a depending annular wall defining a cavity into which an adaptor for the delivery tube extends and is snap fitted in place by the provision of a retention feature coacting between a nipple of the adaptor and the annular wall. A vent port located in the annular wall in the vicinity of the coacting retention feature with an air gap provided between the vent port and the upper surface of the closure end wall. Alternatively, the vent port is located in the end wall of the closure. A cover is provided for sealing closed both the inlet opening from the container and the vent port in a condition of non-use.

7 Claims, 5 Drawing Sheets

FLEXIBLE FLUID DELIVERY TUBE TO RIGID DIP TUBE QUICK CONNECTOR FOR LIQUID SPRAYER

This application is related to and claims priority from earlier filed U.S. Provisional Patent Application No. 60/539,744, filed Jan. 29, 2004.

BACKGROUND OF THE INVENTION

1. Field of the Invention

This invention relates generally to a manually actuated dispenser connected by its flexible fluid delivery tube to a container of chemical liquid to be sprayed. More particularly, the invention relates to a quick connector assembly between the flexible fluid delivery tube and a rigid dip tube suspended from the container closure and extending into the chemical liquid in the container.

2. State of the Art

U.S. Pat. No. 6,409,052, commonly owned herewith and the entirety of the disclosure of which is specifically incorporated herein by reference, discloses such a quick connect assembly of the aforementioned type. A stepped bore is formed in the end wall of the closure for reception of an adaptor secured to an end of the flexible delivery tube. The stepped bore defines first and second annular walls, the latter of a reduced diameter, with an annular base wall interconnecting those walls. Another feature includes the provision of a vent port in the annular base wall, a vent path being established between the adaptor and the stepped bore from the vent port to atmosphere.

Although the quick connector arrangement according to the U.S. Pat. No. 6,409,052 performs satisfactorily, improvements thereon are desirable for the sake of simplicity and efficiency, ease of manufacture, assembly and use.

SUMMARY OF THE INVENTION

It is therefore an object of the present invention to provide a quick connect assembly for a flexible fluid delivery tube to a rigid dip tube for a liquid sprayer, as an improvement over the quick connect assembly disclosed in the aforementioned U.S. Pat. No. 6,409,052. Specifically, the assembly according to the invention provides an annular wall depending from the end wall of the closure which defines a cavity for the reception of the adaptor secured to the free end of the flexible delivery tube. A cylindrical skirt depends from a perforate lower wall of such annular wall for suspending the dip tube into the container. The tube adaptor has a hollow nipple securely connected to a free end of the delivery tube and is removably secured within the annular wall of the closure in open communication with the dip tube. A coacting retention feature is provided between the nipple and the confronting annular wall.

A vent port in accordance with one embodiment of the invention is provided in the annular wall adjacent the retention feature, and an air gap is defined between the nipple and the annular wall from the vent port to atmosphere. In accordance with another embodiment, the vent port is located in the upper end wall of the container and a removable cover or plug is provided overlying that vent port in a condition of non-use. Thus, the vent port may be located in a depression in that upper end wall wherein the cover comprises a removable plug extending into the depression. Otherwise, the cover may have a depending sleeve which extends into the cavity in the non-use condition, and snap beads may be provided between the cover and the closure for positively retaining the cover in place. Still further, the snap beads may be located at the periphery of the cover and the closure, or the snap beads may be provided between a sleeve on the cover and the wall defining the cavity for positively retaining the cover in place during the non-use condition.

Other objects, advantages and novel features of the invention will become more apparent from the following detailed description of the invention when taken in conjunction with the accompanying drawings.

DETAILED DESCRIPTION OF THE INVENTION

Figure 1:
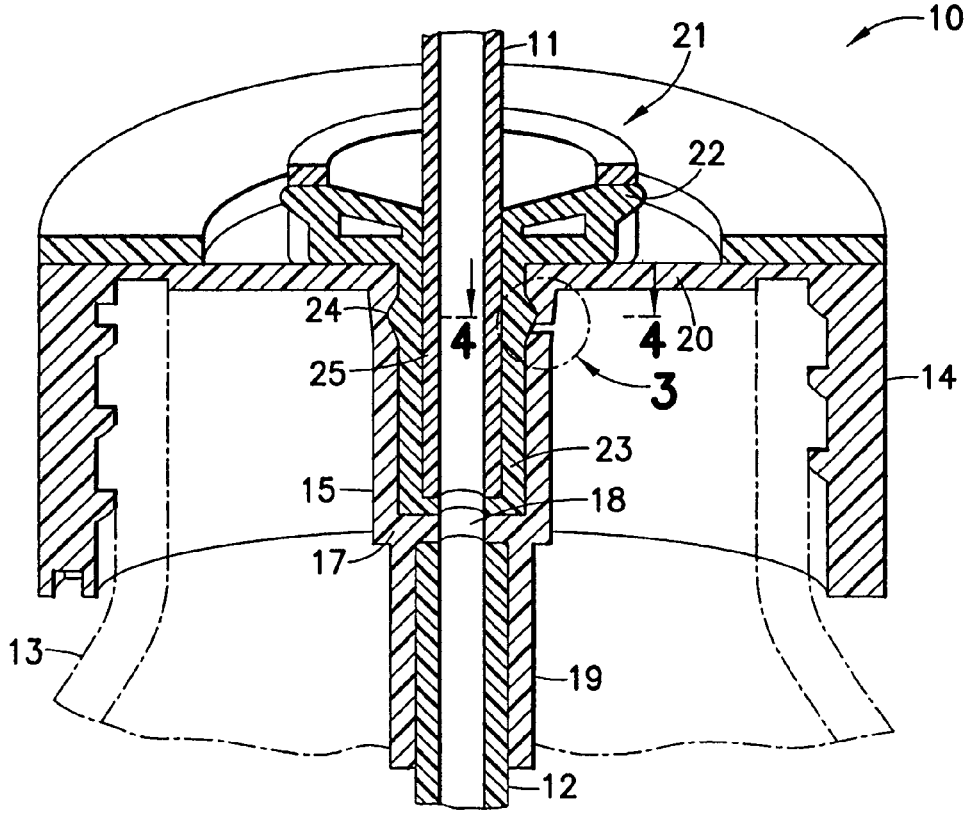
FIG. 1 is a vertical sectional view taken through an assembly according to the invention for quick connecting a flexible fluid delivery tube to a rigid dip tube for a liquid dispenser, according to one embodiment.
Figure 2:
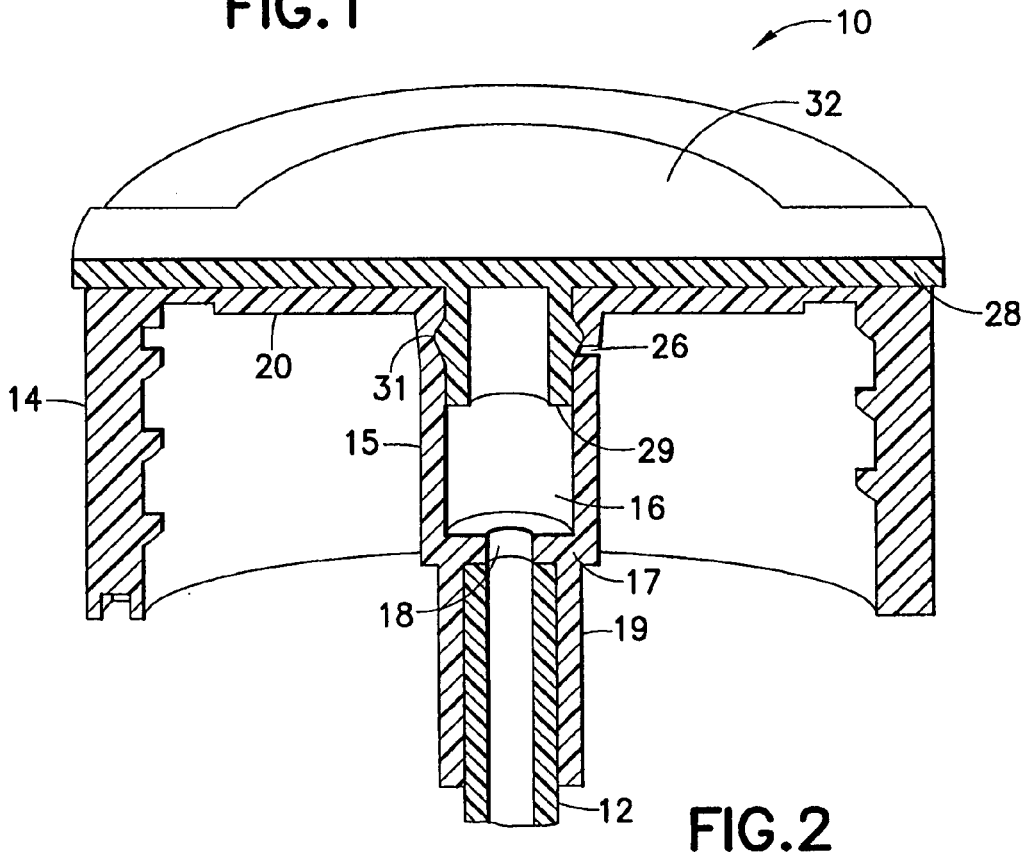
FIG. 2 is a view similar to FIG. 1 showing the adaptor and the flexible delivery tube removed, and including a cover applied in a non-use condition.

Turning now to the drawings wherein like reference characters refer to like and corresponding parts throughout the several views, an assembly generally designated 10 is disclosed in FIGS. 1 and 2 in accordance with a first embodiment according to the invention, for connecting a flexible delivery tube 11 to a rigid dip tube 12 which extends in the usual manner into a container 13 toward the container bottom wall to form an inlet passage for the chemical liquid from the container to a hand held liquid sprayer (not shown).

Assembly 10 includes a closure cap 14 internally threaded for coupling to a threaded container neck for mounting the quick connector assembly in place. Of course, the container closure could be of the snap fitting type without departing from the invention. The closure has an upper end wall 20 which includes a depending annular wall 15 defining an open cavity 16. A lower wall 17 of annular wall 15 defines a central opening 18. Lower wall 17 also supports a depending cylindrical skirt 19 suspending dip tube 12 which extends into the chemical liquid in the container.

A tube adaptor 21 is tightly secured to the free end of the flexible delivery tube 11 in some suitable manner. The adaptor may be of the type disclosed in the aforementioned U.S. Pat. No. 6,409,052 as having a circular body 22. Otherwise, the adaptor will not be described in detail here. The adaptor may likewise be of any known type as having a hollow nipple 23 receiving the free end of the delivery tube, and being inserted into cavity 16 in the FIG. 1 position of use. The adaptor is removably secured within cavity 16 in open communication with opening 18 so as to be open to the inlet from a container through dip tube 12.

Figure 4:
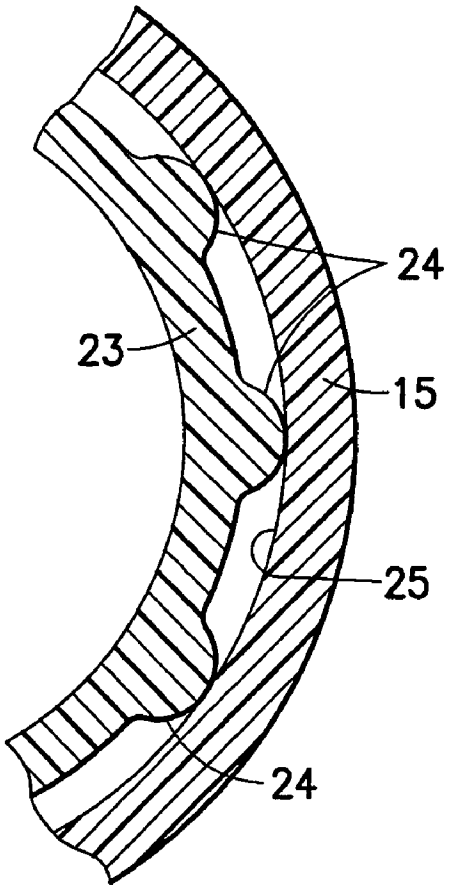
FIG. 4 is a sectional view taken substantially along the line 4-4 of FIG. 1
Figure 3:
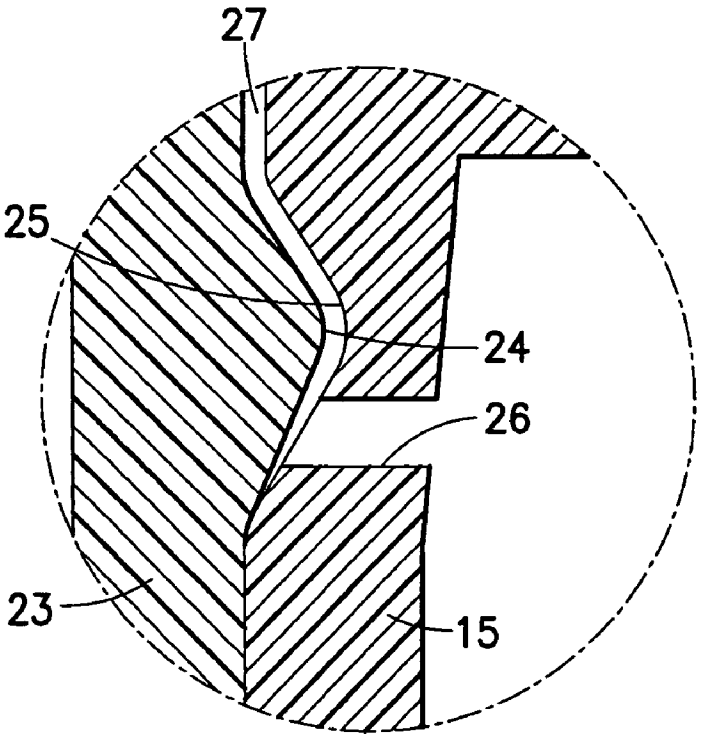
FIG. 3 is a sectional view taken at detail 3 in FIG. 1.

There is a retention feature for retaining the adaptor within the cavity, such a feature including coacting elements between the nipple and the confronting annular wall 15. As shown in FIG. 1, such a retention feature may include a detent 24 which, as shown in detail in FIGS. 3 and 4, can be in the form of a discontinuous annular rib (e.g., spaced bumps). Otherwise, the detent or detents could be connected to form a continuous annular rib. The coacting portion in the surface of annular wall 15 may comprise an annular groove 25 for the reception of the discontinuous or continuous rib/detent(s) when the adaptor is inserted into recess 16.

In accordance with the FIG. 1 embodiment, a vent port 26 is located in annular wall 15 in the vicinity of the coacting retention feature, such that the vent port 26 may open into annular groove 25. And, an air gap 27 (FIG. 3) is established between nipple 23 and wall 15 from the vent port to the outer surface of end wall 20 of the container closure. The air gap may be established by the normal loose tolerances between the nipple and annular wall 15 in the upper vicinity of the cavity, or may be established by undersizing the outer diameter of nipple 23 above the vent, undersizing the inner diameter of wall 15 above the vent, or by the provision of a vertical groove or grooves (not shown) in the nipple or in wall 15 and extending from the vent to the upper surface of end wall 20.

If the adaptor is of the type illustrated having a circular body 22, such that with the nipple inserted in place body 22 is spaced slightly above the top of wall 20. Otherwise, the loose tolerance between the parts can simply provide for a vent path to atmospheric into the container via the vent port so that the volume of the contents of the chemical liquid being discharged during operation of the manual dispenser is replenished with air via the open vent to avoid container collapse and any interference with the smooth operation of the dispenser.

In the non-use condition of FIG. 2 with the adaptor and its supply tube removed from cavity 16, the vent port may be closed by a cover 28 which may have a central, depending, short circular skirt 29 with an annular retention rib 31, the skirt extending into cavity 16 with its rib 31 snapped into place within groove 25. Other retention elements can be provided, of course, without departing from the invention.

The cover is shown as having a central portion 32 received within a corresponding recess in the end wall of the closure, and otherwise having an outer dimension substantially the same as the diameter of the closure. Otherwise, the cover may be in the form of a plug, with or without a retention bead, inserted into the open cavity 16, and which may be tethered to the closure in some fashion, or may be simply formed as a separate part. Thus, in the FIG. 2 condition of non-use, the vent port is sealed close against leakage during shipping, storage and other conditions of non-use.

Figure 5:
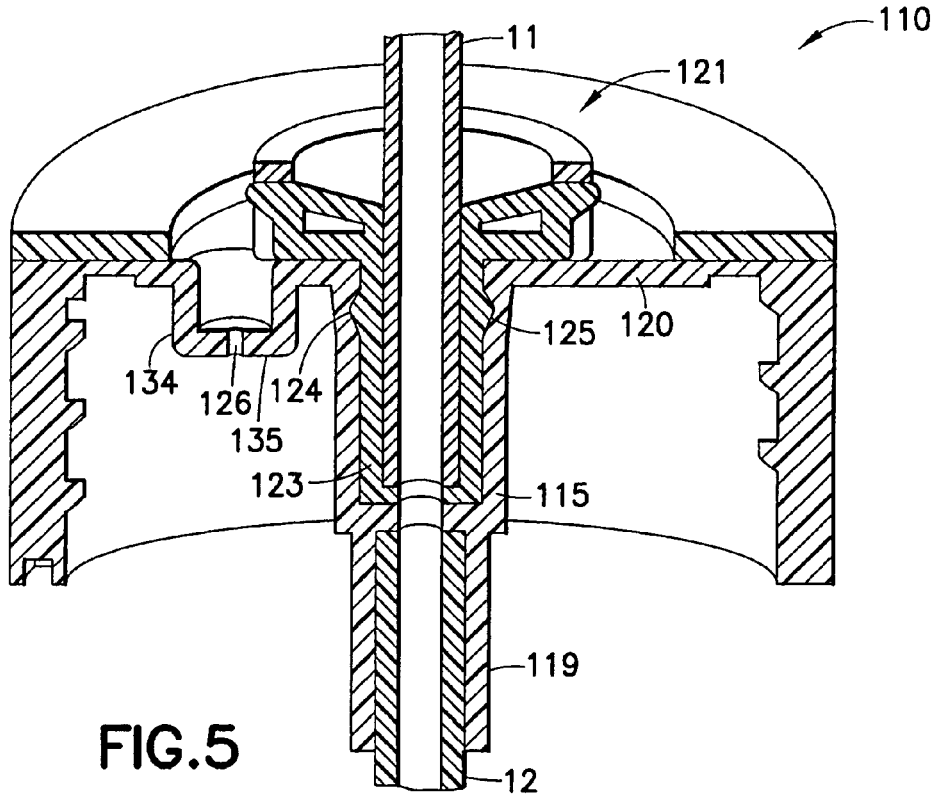
FIG. 5 is a view similar to FIG. 1 of another embodiment according to the invention.
Figure 6:
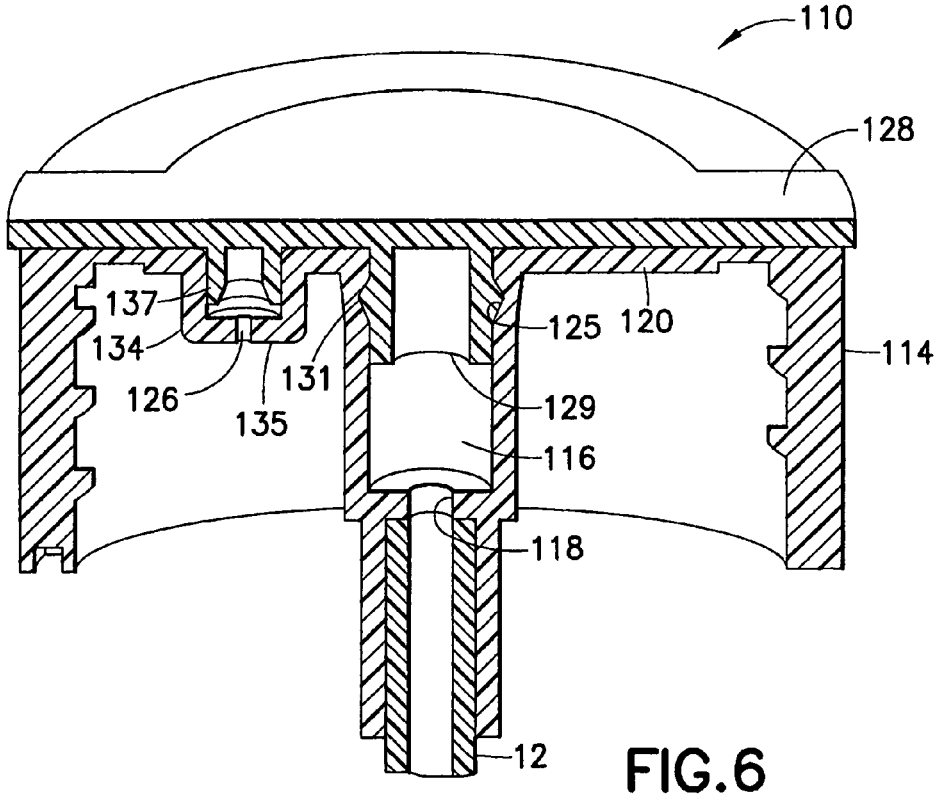
FIG. 6 is a view similar to FIG. 5 with the adaptor and flexible delivery tube removed and with a cover attached in a non-use condition.

Assembly 110 is another embodiment according to the invention shown in FIGS. 5 and 6. Assembly 110 is essentially the same as that of assembly 10 of FIGS. 1-4, except that vent port 126 is located in the end wall 120 of the closure, and the detent or rib 124 on nipple 123 snaps into or is otherwise received within groove 125 in annular wall 115 so as to be thereby retained in place within cavity 116. More specifically, end wall 120 may be provided with a cup-shaped depression 134 of end wall 210 with vent port 126 located in bottom wall 135 of that depression as shown or in the circular side wall thereof. During use, the interior of the container is vented directly to atmosphere through open vent port 126 which is unobstructed.

In the non-use condition of FIG. 6, adaptor 121 with its nipple is removed from recess 116 together with delivery tube 11, and the vent is sealed closed by the provision of a cover 128 having a depending circular skirt 137 acting as a plug extending into the cup-shaped depression 134 in sealing engagement with the inner circular wall thereof. The cover may have a centrally located depending skirt 129 extending into cavity 116, the skirt having an annular retention rib 131 in snug engagement with the mating annular groove 125 located in the confronting surface of annular wall 115. Otherwise, the cover may be in the form of two interconnect or unconnected plugs respectively formed of skirts 137 and 129 extending within their respective recesses, the plugs being separate or connected parts or being tethered to the closure cap by a strap or the like (not shown) in some fashion. Thus, in the FIG. 6 condition, any leakage of product through opening 118 or through vent 126 is avoided during shipping, storage and other conditions of non-use.

Figure 7:
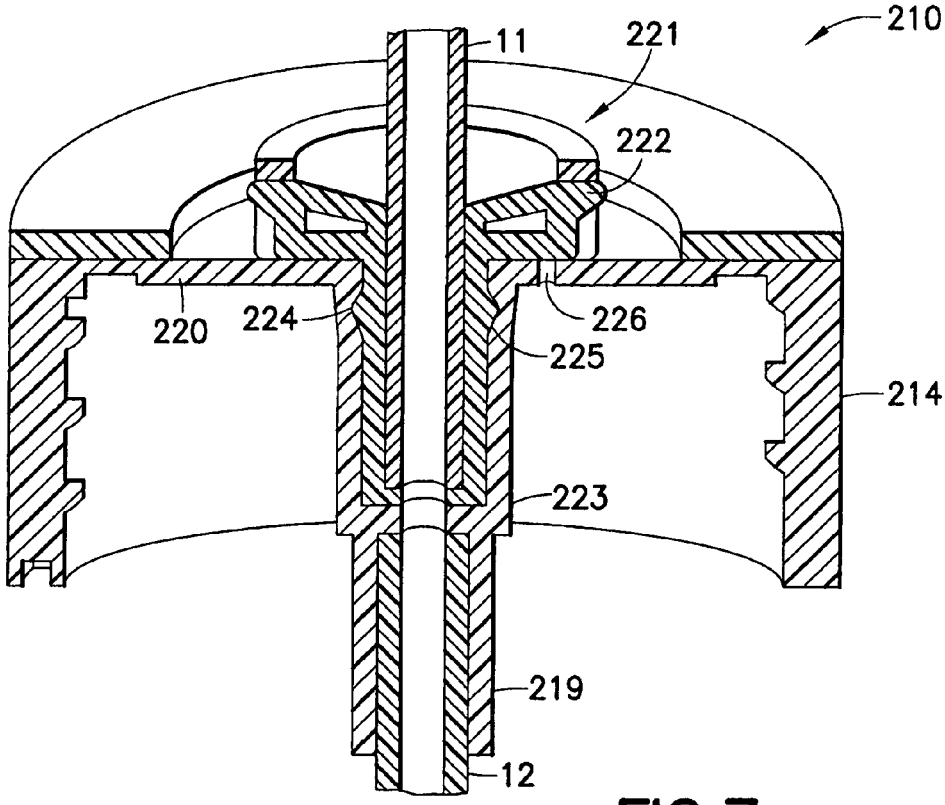
FIG. 7 is a view similar to FIG. 1 of yet further embodiment according to the invention.
Figure 8:
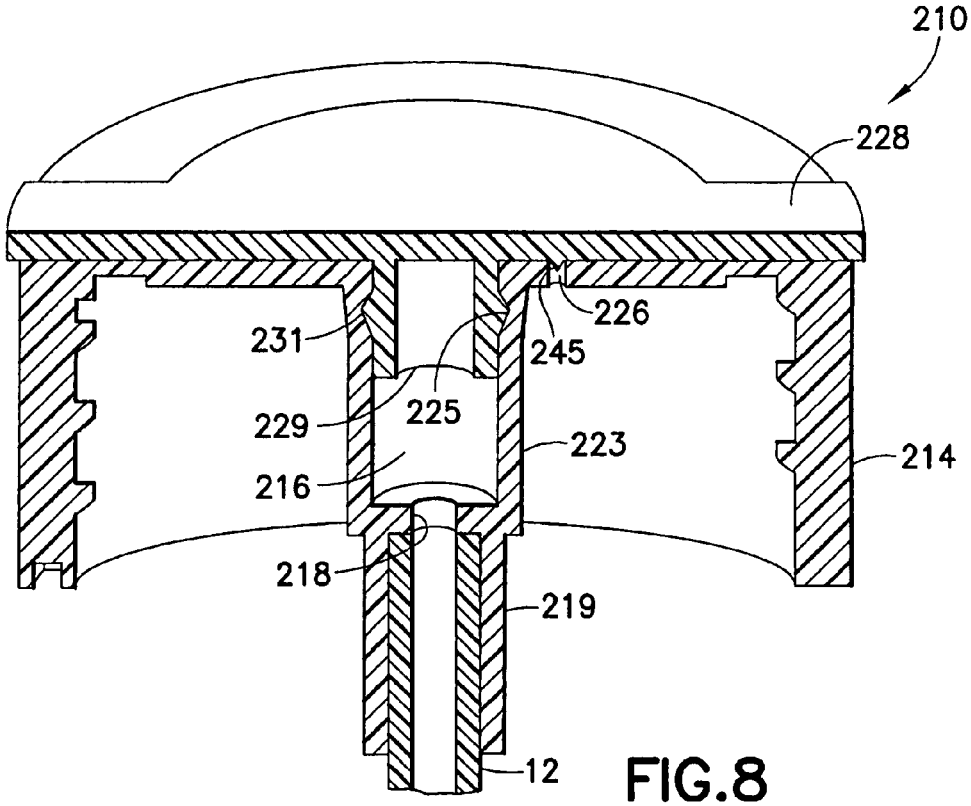
FIG. 8 is a view similar to FIG. 7 with the tube adaptor and flexible delivery tube removed and with a cover shown secured place during a condition of non-use.

Assembly 210 according to the FIGS. 7, 8 embodiment is similar to assembly 110 except that vent port 226 is located in end wall 220 of the closure in the upper flat portion thereof. Thus, in the FIG. 7 use position, the nipple of the adaptor extends into recess 216 with its rib 224 in engagement with groove 225, and body portion 222 of the adaptor is arranged to be spaced slightly above the upper surface of end wall 220 of the closure to maintain the vent open to atmosphere.

In the non-use condition of FIG. 8, with the adaptor removed from recess 216 together with delivery tube 11, cover 228 is applied, the cover having a central depending skirt 229 with an annular rib 231 which snap fits within annular groove 225 in annular wall 223. The underside of cover 228 lies flatly against the top surface of end wall 220 of the closure for sealing the vent closed. A small detent 245 may be provided as extending from the underside of the cover so as to project into vent port 226 to further enhance the seal thereof in the cover closed condition of FIG. 8. Thus, opening 218 is sealed closed together with vent port 226 in the FIG. 8 covered condition during shipping, storage, and other conditions of non-use.

Figure 9:
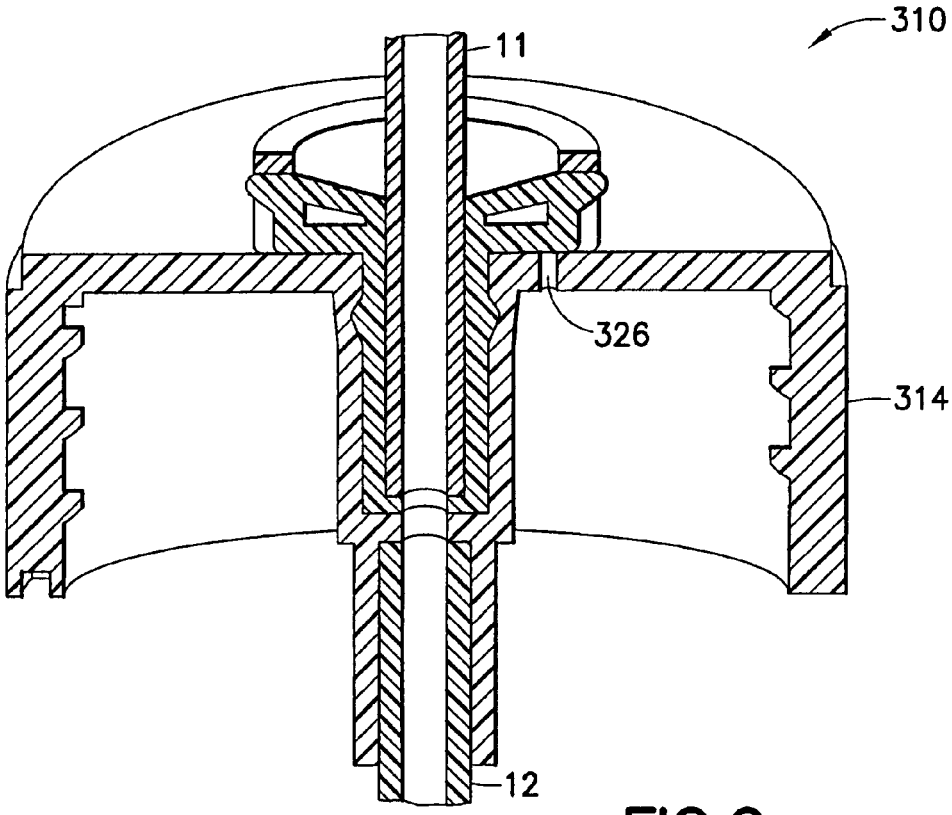
FIG. 9 is a view similar to FIG. 7 of still another embodiment of the invention.
Figure 10:
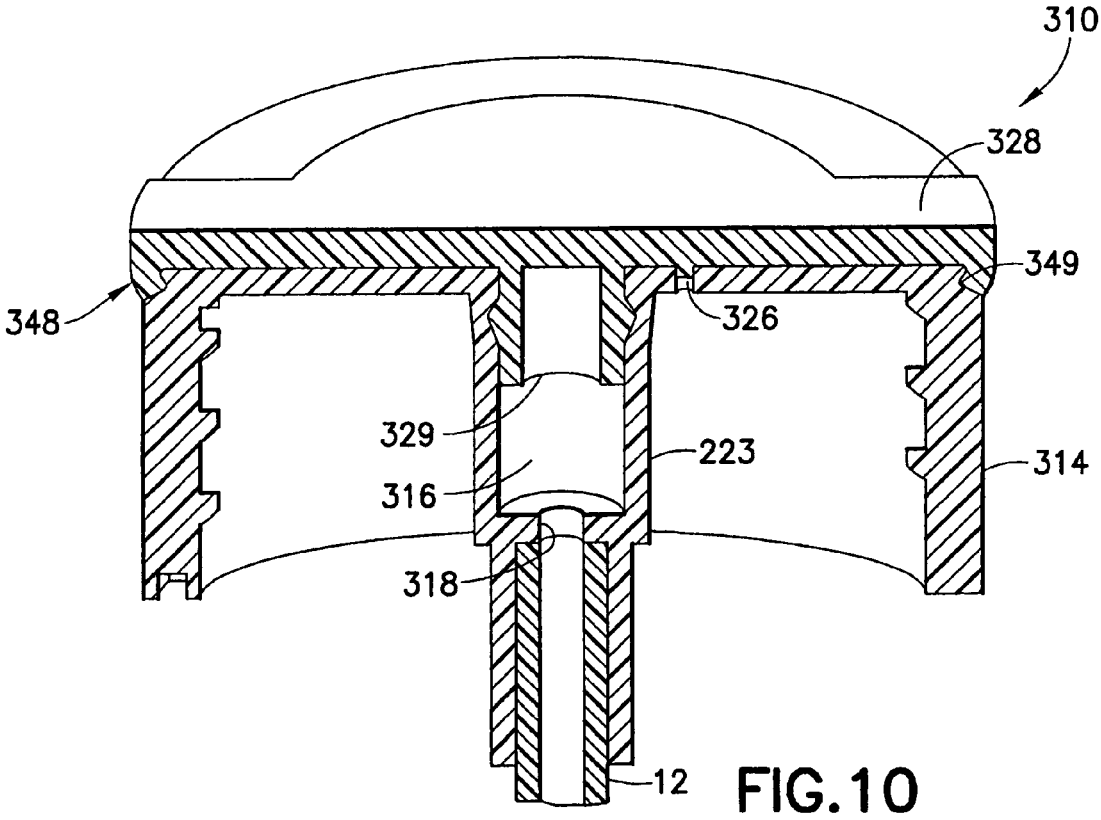
FIG. 10 is a view similar to FIG. 9 with the tube adaptor and flexible delivery tube removed, and with a cover according to yet another embodiment shown affixed in place.

Assembly 310 shown in FIGS. 9, 10 is essentially the same as assembly 210 of FIG. 7, except for cover 328 which has a snap bead 348 about its periphery engaging a peripheral groove 349 on closure 314. The cover may likewise have a central skirt 329 plugged into cavity 316 in the cover closed condition of FIG. 10, and a small detent 345 on its underside extending into the vent port as shown. Thus, during the FIG. 10 condition of shipping, storage, and other conditions of non-use, both inlet opening 318 and the vent port 326 are sealed closed by the cover.

While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as claimed.

What is claimed is:

1. An assembly for connecting a flexible fluid delivery tube to a rigid dip tube for a liquid sprayer, comprising a container closure having a cylindrical side wall extending parallel to a central axis which includes means for engaging a neck of the container, the closure having an upper end wall including an annular wall depending therefrom parallel to the central axis and defining a cavity, a lower wall on the annular wall having a central opening, a cylindrical skirt depending from the lower wall parallel to the central axis for suspending the dip tube, a tube adaptor having a hollow nipple securely connected to a free end of the delivery tube and being removably secured within the annular wall in open communication with said central opening, coacting retention means on an outer surface of said nipple and the confronting annular wall, a vent port in said annular wall adjacent said retention means, and an air gap defined between said nipple and said annular wall leading from said vent port to atmosphere.

2. The assembly according to claim 1, wherein said retention means comprises at least one detent received within a recess.

3. The assembly according to claim 1, wherein said retention means comprises at least one detent on said nipple and a cooperating recess on an outer surface of said annular wall in communication with said air gap.

4. The assembly according to claim 1 further comprising a plug seal extending into said cavity for sealing the vent port closed in a non-use condition.

5. The assembly according to claim 1, wherein said retention means comprises an annular groove in said annular wall in communication with said vent port and said air gap, and at least one detent on said nipple extending into said groove.

6. An assembly for connecting a flexible fluid delivery tube to a rigid dip tube for a liquid sprayer, comprising a container closure having a cylindrical side wall which includes means for engaging a neck of the container, the closure having an upper end wall including an annular wall depending therefrom and defining a cavity, a lower wall on the annular wall having a central opening, a cylindrical skirt depending from the lower wall for suspending the dip tube, a tube adaptor having a hollow nipple securely connected to a free end of the delivery tube, the nipple being removably received within said cavity in open communication with said central opening, coacting retention means on an outer surface of the nipple and a confronting surface of the annular wall, a vent port located in a depression depending from the upper end wall of the closure, the depression separate and distinct from the cavity receiving the nipple, and a removable cover overlying the vent port in a condition of non-use.

7. The assembly according to claim 6, wherein said cover comprises a removable plug which extends into the depression.

* * * * *